US010514653B2

(12) United States Patent
Kawakami et al.

(10) Patent No.: US 10,514,653 B2
(45) Date of Patent: Dec. 24, 2019

(54) IMAGE FORMING APPARATUS AND IMAGE FORMING CONTROL METHOD

(71) Applicant: Konica Minolta, Inc., Chiyoda-ku, Tokyo (JP)

(72) Inventors: Yoshiteru Kawakami, Tokyo (JP); Yasuo Shiokawa, Tokyo (JP); Takahiro Okubo, Kanagawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/291,379

(22) Filed: Mar. 4, 2019

(65) Prior Publication Data

US 2019/0278213 A1 Sep. 12, 2019

(30) Foreign Application Priority Data

Mar. 6, 2018 (JP) ..... 2018-039682

(51) Int. Cl.
*G03G 21/00* (2006.01)
*G03G 15/00* (2006.01)

(52) U.S. Cl.
CPC ..... *G03G 21/0094* (2013.01); *G03G 15/6529* (2013.01)

(58) Field of Classification Search
CPC ..... G03G 15/2025; G03G 15/6529; G03G 21/0005; G03G 21/0011; G03G 21/0035; G03G 21/0094; G03G 2221/005; G03G 2221/007; G03G 2221/1606
USPC ..... 399/38, 66, 71, 123, 297, 301, 343, 346
See application file for complete search history.

(56) References Cited

U.S. PATENT DOCUMENTS 8,406,676 B2 * 3/2013 Taguma ..... G03G 21/00 399/346
8,824,950 B2 * 9/2014 Nakamura ..... G03G 21/0094 118/258
9,122,225 B2 * 9/2015 Uenishi ..... G03G 21/0094
9,383,715 B2 * 7/2016 Honjoh ..... G03G 21/0094

FOREIGN PATENT DOCUMENTS

JP 2014133634 A 7/2014

* cited by examiner

*Primary Examiner* — Hoan H Tran
(74) *Attorney, Agent, or Firm* — Cantor Colburn LLP

(57) ABSTRACT

An image forming apparatus includes: a lubricant supply section that supplies a lubricant of a lubricant rod extending along an axial direction of an image bearing member onto the image bearing member; and a hardware processor that controls displacement of a sheet conveyance member so as to displace a sheet along a width direction of the sheet. The hardware processor performs control of changing a position in the axial direction of the toner image formed on the image bearing member on the basis of a distribution status of a toner in the axial direction in a toner image formed on the image bearing member, and controls displacement of the sheet conveyance member after a tip end of the sheet in the conveyance direction enters the transfer section so that a sheet position in a width direction of an image transferred onto the sheet is correct in the transfer section.

22 Claims, 7 Drawing Sheets

IMAGE FORMING APPARATUS AND IMAGE FORMING CONTROL METHOD

CROSS REFERENCE TO RELATED APPLICATIONS

The present application claims priority under 35 U.S.C. § 119 to Japanese Patent Application No. 2018-039682 filed on Mar. 6, 2018 is incorporated herein by reference in its entirety.

BACKGROUND

Technological Field

The present invention relates to an image forming apparatus and an image forming control method.

Description of Related Art

In general, an image forming apparatus (printer, copier, facsimile machine, or the like) utilizing an electrophotographic process technology irradiates (light exposes) a charged photoconductor drum (image bearing member) with laser light based on image data to form an electrostatic latent image. In the image forming apparatus, a toner is supplied from a developing section to the photoconductor drum on which the electrostatic latent image is formed, so that the electrostatic latent image is visualized to form a toner image. In the image forming apparatus, the toner image is primarily or secondarily transferred onto a sheet, the sheet is heated and pressed with a fixing nip of a fixing section, and the toner image is fixed on the sheet. In the image forming apparatus, a registration roller is provided on the upstream side of a transfer section that transfers an image to a sheet. The registration roller has a function of rotating so as to adjust the conveyance speed of the sheet in order to align the tip end side in the conveyance direction of the sheet with the tip end of the image, and sending the sheet to the transfer section.

Examples of a function of a conventional registration roller include a function (hereinafter, referred to as bending correction) for abutting a conveyed sheet to correct bending on the tip end side in the sheet conveyance direction, that is, skewing. After this bending correction, the registration roller has a function (hereinafter, referred to as positional displacement correction) of performing displacement along the width direction of the sheet to correct positional displacement of the sheet in the width direction (see, for example, Japanese Patent Application Laid-Open No. 2014-133634).

In order to reduce the adhesion force between the photoconductor drum and the toner to improve the transfer rate, to prolong the life of the photoconductor drum, or the like, some image forming apparatuses have a configuration in which a lubricant rod obtained by molding a lubricant made of zinc stearate or the like into a rod shape is supplied to the photoconductor drum.

Here, since the lubricant has a property of easily adhering to a toner, the lubricant rod decreases faster as the coverage becomes higher. If the coverage continues to be high, the transfer residual toner is easy to slip through, and toner, external additives or the like is easy to adhere to the lubricant rod, which causes image defects such as FD streak to be easy to occur. When eccentric location of the coverage occurs such that toner (solid image) is consecutively formed only in a part of the scanning direction (hereinafter, also referred to as axial direction) of the photoconductor drum, a portion of the lubricant rod corresponding to the toner decreases faster. Thus, when the lubricant rod has a nonuniform shape along the width direction, lubricant is hard to be supplied uniformly in the width direction of the photoconductor drum, and image defects are easy to occur.

On the other hand, when the coverage is low, although the decrease of the lubricant rod is gentle, the lubricant which does not adhere to the toner accumulates on the photoconductor drum, so that the lubricant on the photoconductor drum becomes excessive and image defects such as FD streaks are easy to occur. In general, it is desirable to uniformly apply a lubricant on the photoconductor drum from the viewpoints of the above-described improvement in the transfer rate, the longer life of the photoconductor drum, and the like.

In some image forming apparatuses, in order to prevent deterioration of the toner in the developing device and achieve uniform application of the lubricant on the photoconductor drum, control (RFP control) for discharging a toner band called a refresh toner patch is performed between sheets. According to this RFP control, relatively old toner is discharged as a refresh toner patch over the axial direction on a photoconductor, so that deterioration of the toner in the developing device can be prevented. According to the RFP control, the lubricant of the lubricant rod adheres to the refresh toner patch, and the lubricant can be uniformly applied in the axial direction of the photoconductor.

On the other hand, this RFP control is performed exclusively when the coverage is low, and if the RFP control is performed in the case where the coverage is eccentrically located as described above, problems occur such as the toner consumption amount increases, or the productivity of printing decreases.

SUMMARY

An object of the present invention is to provide an image forming apparatus and an image forming control method capable of suppressing unevenness in lubricant supply to a photoconductor and improving the quality of an image to be printed.

To achieve at least one of the abovementioned objects, according to an aspect of the present invention, an image forming apparatus reflecting one aspect of the present invention comprises:

an image former including a transferer that transfers a toner image formed on an image bearing member to a sheet;

a lubricant supplier that supplies the image bearing member with a lubricant of a lubricant rod extending along an axial direction of the image bearing member;

a sheet conveyance member that is provided in a upstream side of the transferer in a sheet conveyance direction, and conveys the sheet; and a hardware processor that controls displacement of the sheet conveyance member so as to displace the sheet along a width direction of the sheet, wherein the hardware processor performs control of changing a position in the axial direction of the toner image formed on the image bearing member, on the basis of a distribution status of a toner in the axial direction in the toner image formed on the image bearing member, and controls displacement of the sheet conveyance member after a tip end of the sheet in the conveyance direction enters the transferer so that a sheet position in a width direction of an image transferred onto the sheet is correct in the transferer.

To achieve at least one of the abovementioned objects, according to an aspect of the present invention, an image forming control method reflecting one aspect of the present invention is an image forming control method in an image forming apparatus comprising: an image former comprising a transferer that transfers a toner image formed on an image bearing member to a sheet; a lubricant supplier that supplies a lubricant of a lubricant rod extending along an axial direction of the image bearing member onto the image bearing member; and a sheet conveyance member that is provided on an upstream side of the transferer in a sheet conveyance direction, and conveys the sheet, the method comprising:

changing a position in the axial direction of the toner image formed on the image bearing member, on the basis of a distribution status of a toner in the axial direction in the toner image formed on the image bearing member and displacing the sheet conveyance member after a tip end of the sheet in the conveyance direction enters the transferer so that a sheet position in a width direction of the toner image transferred onto the sheet is correct.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
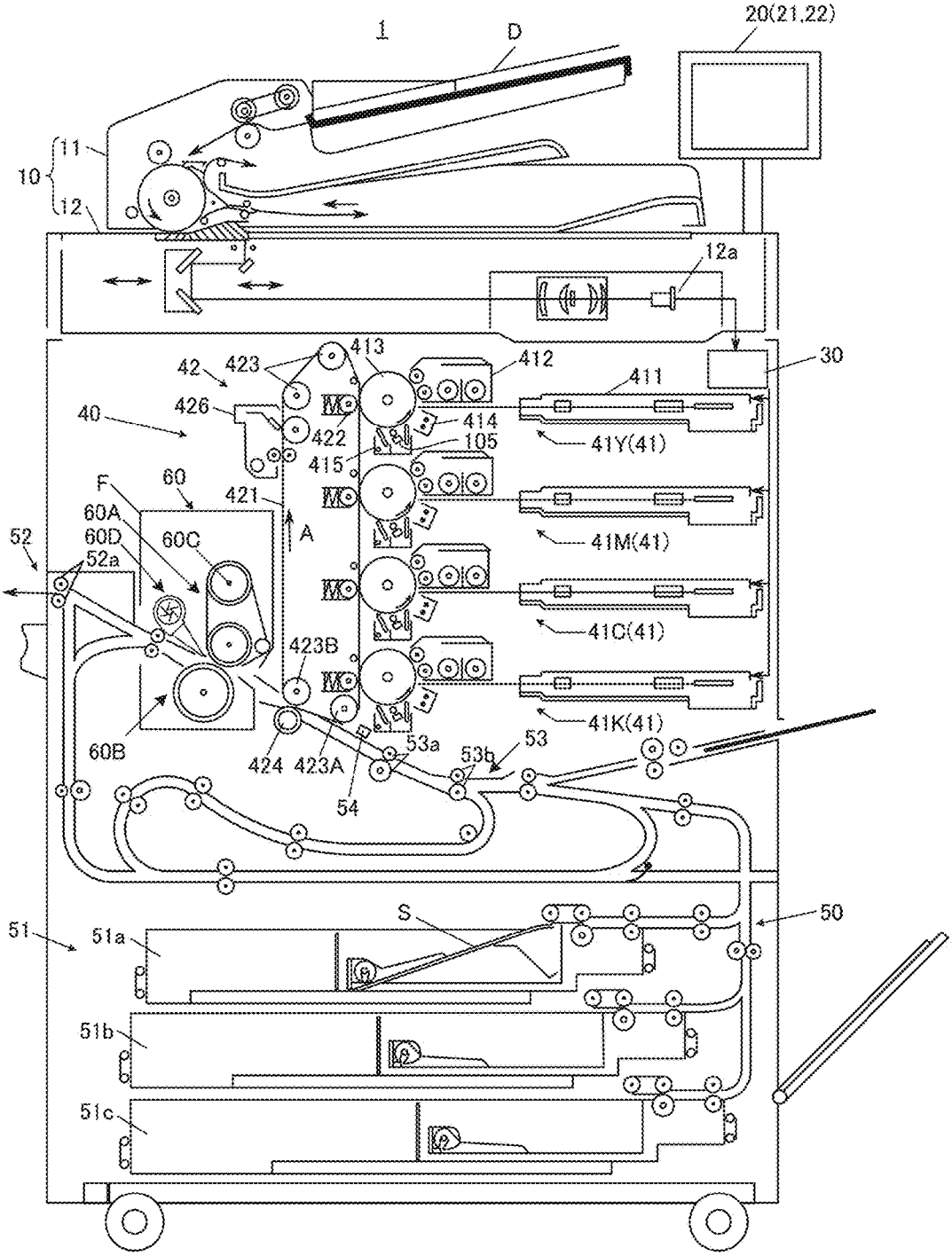
FIG. 1 is a diagram schematically showing the overall configuration of an image forming apparatus according to the present embodiment.
Figure 2:
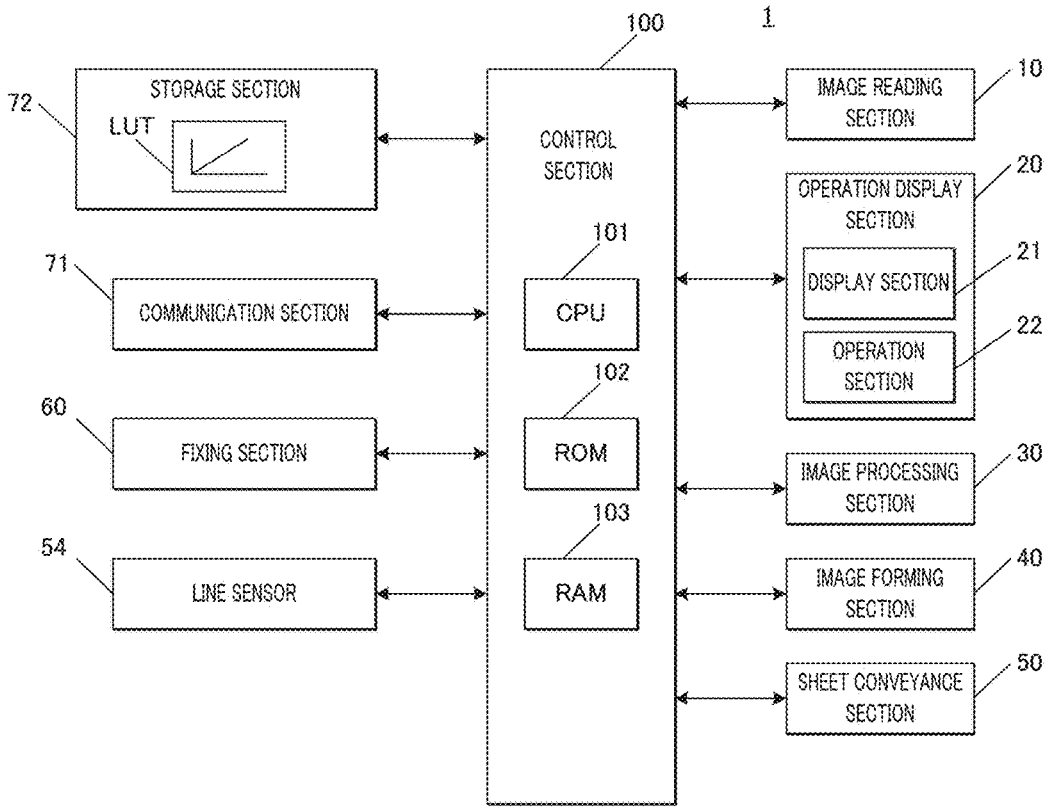
FIG. 2 is a diagram showing a main part of a control system of the image forming apparatus according to the present embodiment.

FIG. 1 is a diagram schematically showing the overall configuration of image forming apparatus 1 according to the present embodiment. FIG. 2 shows a main part of a control system of image forming apparatus 1 according to the present embodiment.

In image forming apparatus 1 of the present embodiment, a long sheet or non-long sheet is used as sheet S, and an image is formed on sheet S.

In the present embodiment, the long sheet is a sheet paper having a longer length in a conveyance direction than that of generally used sheets of A4 size, A3 size, or the like, and has a length that cannot be accommodated in sheet feed tray units 51*a* to 51*c* in a machine. Hereinafter, when simply referred to as "sheet", both long sheet and non-long sheet may be included.

Image forming apparatus 1 is an intermediate transfer type color image forming apparatus utilizing an electrophotographic process technology. That is, image forming apparatus 1 primarily transfers toner images of each color of yellow (Y), magenta (M), cyan (C), and black (K) formed on photoconductor drum 413 to intermediate transfer belt 421, superimposes four color toner images on intermediate transfer belt 421, and then, secondarily transfers the toner images onto a sheet to form a toner image.

In image forming apparatus 1, the tandem system is adopted in which photoconductor drum 413 corresponding to the four colors of Y, M, C, and K are arranged in series in a traveling direction of intermediate transfer belt 421, and the toner images of each color are sequentially transferred to intermediate transfer belt 421 in a single procedure.

As shown in FIG. 2, image forming apparatus 1 includes image reading section 10, operation display section 20, image processing section 30, image forming section 40, sheet conveyance section 50, fixing section 60, control section 100, and the like.

Control section 100 includes a central processing unit (CPU) 101, a read only memory (ROM) 102, a random access memory (RAM) 103, and the like. CPU 101 reads a program corresponding to the processing content from the ROM 102, develops the program in the RAM 103, and cooperates with the developed program to centrally control the operation of each block of image forming apparatus 1. At this time, various types of data stored in storage section 72 is referred to. Storage section 72 includes, for example, a nonvolatile semiconductor memory (so-called flash memory) or a hard disk drive.

Control section 100 transmits and receives various types of data with external devices (for example, a personal computer (PC)) connected to a communication network such as a local area network (LAN), or a wide area network (WAN) via communication section 71. For example, control section 100 receives image data transmitted from an external device and causes a toner image to be formed on a sheet on the basis of the image data (input image data). Communication section 71 includes a communication control card such as a LAN card.

Image reading section 10 includes automatic document feeding device 11 called an auto document feeder (ADF), a document image scanning device (scanner) 12, and the like.

Automatic document feeding device 11 conveys document D placed on a document tray by a conveyance mechanism and sends document D to document image scanning device 12. Automatic document feeding device 11 can consecutively read images (including both sides) of a large number of documents D placed on the document tray at once.

Document image scanning device 12 optically scans a document conveyed onto a contact glass from automatic document feeding device 11 or a document placed on the contact glass, and forms an image of light reflected from the document onto a light receiving surface of a charge coupled device (CCD) sensor 12*a*, to read the document image. Image reading section 10 generates input image data on the basis of a reading result by document image scanning device 12. The input image data is subjected to predetermined image processing in image processing section 30.

Operation display section 20 includes, for example, a liquid crystal display (LCD) with a touch panel, and functions as display section 21 and operation section 22. Display section 21 displays various types of operation screen, image state display, operation status of each function, or the like according to a display control signal input from control section 100. Operation section 22 includes various types of operation key such as a numeric key pad, or a start key, accepts various types of input operation by a user, and outputs an operation signal to control section 100.

Image processing section 30 includes a circuit or the like for performing digital image processing according to initial setting or user setting on the input image data. For example, under the control of control section 100, image processing section 30 performs tone correction on the basis of tone correction data (tone correction table LUT) in storage section 72. In addition to the gradation correction, image processing section 30 applies various types of correction processing such as tone correction, or shading correction, compression processing, or the like, to the input image data. Image forming section 40 is controlled on the basis of the image data subjected to these processes.

Image forming section 40 includes image forming units 41Y, 41M, 41C, and 41K that form images with color toners of Y component, M component, C component, and K component on the basis of the input image data, intermediate transfer unit 42, and the like.

Image forming units 41Y, 41M, 41C, and 41K for Y component, M component, C component, and K component have a similar configuration. For convenience of illustration and explanation, the same constituent elements are denoted by the same reference numerals, and when distinguishing them, Y, M, C, or K is added to the reference numerals. In FIG. 1, only the constituent elements of image forming unit 41Y for the Y component are denoted by reference numerals, and the reference numerals of the constituent elements of other image forming units 41M, 41C, 41K are omitted.

Image forming unit 41 includes exposing device 411, developing device 412, photoconductor drum 413, charging device 414, drum cleaning device 415, and the like.

Photoconductor drum 413 is a negative charge type organic photo-conductor (OPC) having an under coat layer (UCL), a charge generation layer (CGL), and a charge transport layer (CTL) sequentially laminated in this order on a circumferential surface of an aluminum conductive cylindrical body (aluminum element tube), for example. The charge generation layer is made of an organic semiconductor in which a charge generation material (for example, a phthalocyanine pigment) is dispersed in a resin binder (for example, polycarbonate), and generates a pair of positive and negative charges upon light exposure by the exposing device 411.

The charge transport layer is formed by dispersing a hole transport material (electron applying nitrogen-containing compound) in a resin binder (for example, polycarbonate resin), and transports positive charges generated in the charge generation layer to the surface of the charge transport layer.

Control section 100 controls a driving current supplied to a driving motor (not shown) that rotates photoconductor drum 413 to rotate photoconductor drum 413 at a constant circumferential speed (linear velocity).

Charging device 414 uniformly charges the surface of photoconductor drum 413 having an optical conductivity to negative polarity. Exposing device 411 includes, for example, a semiconductor laser, and irradiates photoconductor drum 413 with laser lights corresponding to images of color components. As a result, an electrostatic latent image of each color component is formed on the surface of photoconductor drum 413 due to a potential difference with the surroundings.

Developing device 412 is, for example, a two-component developing type developing device, and adheres toners of each color component to the surface of photoconductor drum 413 to visualize the electrostatic latent image to form a toner image.

Drum cleaning device 415 has a cleaning blade or the like that is in sliding contact with the surface of photoconductor drum 413. Drum cleaning device 415 removes a transfer residual toner remaining on the surface of photoconductor drum 413 after the primary transfer by a cleaning blade.

Intermediate transfer unit 42 includes intermediate transfer belt 421, primary transfer roller 422, a plurality of support rollers 423, secondary transfer roller 424, belt cleaning device 426, and the like.

Intermediate transfer belt 421 is formed of an endless belt, and is looped around the plurality of support rollers 423. At least one of the plurality of support rollers 423 includes a driving roller, and the others include a driven roller. For example, it is preferable that a roller 423A arranged in a downstream side of primary transfer roller 422 for the K component in the belt traveling direction is a driving roller. This makes it easier to keep the traveling speed of the belt at the primary transfer section constant. As the driving roller 423A rotates, intermediate transfer belt 421 travels at a constant speed in the direction of arrow A.

Primary transfer roller 422 is arranged on an inner circumferential surface side of intermediate transfer belt 421 so as to face photoconductor drum 413 of each color component. Primary transfer roller 422 is pressed against and brought into contact with photoconductor drum 413 with intermediate transfer belt 421 in between, so that a primary transfer nip for transferring a toner image from photoconductor drum 413 to intermediate transfer belt 421 is formed.

Secondary transfer roller 424 is arranged on the outer peripheral surface side of intermediate transfer belt 421 so as to face a backup roller 423B arranged on the downstream side in the belt traveling direction of the driving roller 423A. Secondary transfer roller 424 is pressed against and brought into contact with the backup roller 423B with intermediate transfer belt 421 in between, so that a secondary transfer nip for transferring a toner image from intermediate transfer belt 421 to sheet S is formed.

Secondary transfer nip including intermediate transfer belt 421, the backup roller 423B, and secondary transfer roller 424 corresponds to the "transfer section" of the present invention.

When intermediate transfer belt 421 passes through the primary transfer nip, the toner images on photoconductor drum 413 are sequentially superimposed and primarily transferred onto intermediate transfer belt 421. Specifically, a primary transfer bias is applied to primary transfer roller 422, and a charge having a polarity opposite to that of the toner is applied to the side of intermediate transfer belt 421 in contact with primary transfer roller 422, so that the toner image is electrostatically transferred onto intermediate transfer belt 421.

Thereafter, when sheet S passes through the secondary transfer nip, the toner image on intermediate transfer belt 421 is secondarily transferred onto sheet S. Specifically, a secondary transfer bias is applied to secondary transfer roller 424, and a charge having a polarity opposite to that of the toner is applied to the side of sheet S in contact with secondary transfer roller 424, so that the toner image is electrostatically transferred onto sheet S. Sheet S on which the toner image has been transferred is conveyed toward fixing section 60.

Belt cleaning device 426 has a belt cleaning blade or the like in sliding contact with the surface of intermediate transfer belt 421, and removes a transfer residual toner remaining on the surface of intermediate transfer belt 421 after the secondary transfer.

Fixing section 60 includes upper fixing section 60A having a fixing surface side member arranged on the fixing surface side of sheet S, lower fixing section 60B having a back surface side support member arranged on the surface side opposite to the fixing surface of sheet S, heating source 60C, and the like. The back side support member is pressed against and brought into contact with the fixing surface side member, so that a fixing nip for nipping and conveying sheet S is formed.

In fixing section 60, the toner image is secondarily transferred, and conveyed sheet S is heated and pressurized at the fixing nip to fix the toner image on sheet S. Fixing section 60 is arranged as a unit in fixing device F. Air separation unit 60D that separates sheet S from the fixing surface side member by blowing air is arranged on fixing device F.

Sheet conveyance section 50 includes sheet feed section 51, sheet ejection section 52, conveyance path section 53, and the like. Sheet S (standard sheet, special sheet) identified on the basis of basis weight (stiffness), size, or the like is accommodated in each of three sheet feed tray units 51*a* to 51*c* constituting sheet feed section 51, for each preset type. Conveyance path section 53 includes: a plurality of conveyance rollers such as registration roller pair 53*a* or loop roller 53*b*; a double-sided conveyance path for formation of images on both sides of sheet S; external sheet feed conveyance path for feeding sheet S from the outside (the right side in FIG. 1) of the apparatus; or the like. Registration roller pair 53*a* corresponds to the "registration roller" of the present invention.

Registration roller pair 53*a* plays a role of correcting the bending of sheet S under the control of control section 100 and a role of correcting the positional displacement of sheet S. Under the control of control section 100, registration roller pair 53*a* has a function of rotating so as to align the position of the toner image secondarily transferred onto the sheet to adjust the conveyance speed of the sheet.

Here, bending correction is for abutting conveyed sheet S against registration roller pair 53*a* to correct bending on the tip end side in the conveyance direction of sheet S, that is, skewing. In the present embodiment, at the time of correcting the bending of sheet S, control section 100 outputs a control signal to a drive source (such as a motor) of registration roller pair 53*a*, so that the rotation of registration roller pair 53*a* is controlled.

On the other hand, the position displacement correction is for displacing registration roller pair 53*a* to correct the position of sheet S in the width direction. That is, after sheet S is nipped by the nip of registration roller pair 53*a* (hereinafter, also referred to as a registration nip), control is performed, the control of displacement operation (registration displacement) in which registration roller pair 53*a* moves in the width direction to move sheet S, so that the position of sheet S in the width direction is corrected. In the present embodiment, a motor (stepping motor or the like) different from the motor for rotating registration roller pair 53*a* is used as the drive source for displacing registration roller pair 53*a*. Details of the control contents of registration displacement will be described later.

Loop roller 53*b* is a pair of rollers arranged on the upstream side of registration roller pair 53*a* in the conveyance direction. Under the control by control section 100, loop roller 53*b* rotates so as to form a loop on sheet S between loop roller 53*b* and registration roller pair 53*a*, thereby cooperating with registration roller pair 53*a* to correct the bending of sheet S.

Line sensor 54 is arranged on the upstream side of the secondary transfer nip on the downstream side of registration roller pair 53*a* in the sheet conveyance direction. Line sensor 54 is a sensor in which photoelectric conversion elements are arranged in a line shape, plays a roll of detecting one end portion of sheet S in the width direction (hereinafter, referred to as a side end), to detect offset of sheet S (displacement from the standard or target position (see dotted line $TP_0$ in FIG. 6 to be described later)).

Sheet S accommodated in sheet feed tray units 51*a* to 51*c* are sent one by one from the uppermost portion and are conveyed to image forming section 40 by conveyance path section 53. Alternatively, sheet S is conveyed from a sheet feed device connected to an external sheet feed tray or image forming apparatus 1 (none of them is not shown) to image forming section 40 via the above-described external sheet feed conveyance path. At this time, the tip end side of fed sheet S in the conveyance direction is abutted against registration roller pair 53*a*, and the tip end side is set to be parallel to the axis of registration roller pair 53*a*, so that the bending of sheet S is corrected (bending correction) and the conveyance timing of sheet S is adjusted.

In image forming section 40, the toner image of intermediate transfer belt 421 is secondarily transferred collectively to one surface of sheet S, and a fixing step is performed in fixing section 60. Sheet S on which an image has been formed is ejected to the outside of the machine by sheet ejection section 52 having sheet ejection roller 52*a*. In double-sided printing, sheet S on which image formation on a first surface is performed is switch-back conveyed via the double-sided conveyance path, tip and rear ends in the conveyance direction are inversed, the front and back are reversed, then, the toner image is secondarily transferred and fixed on a second surface, and sheet S is ejected to the outside of the machine by sheet ejection section 52.

Figure 3:
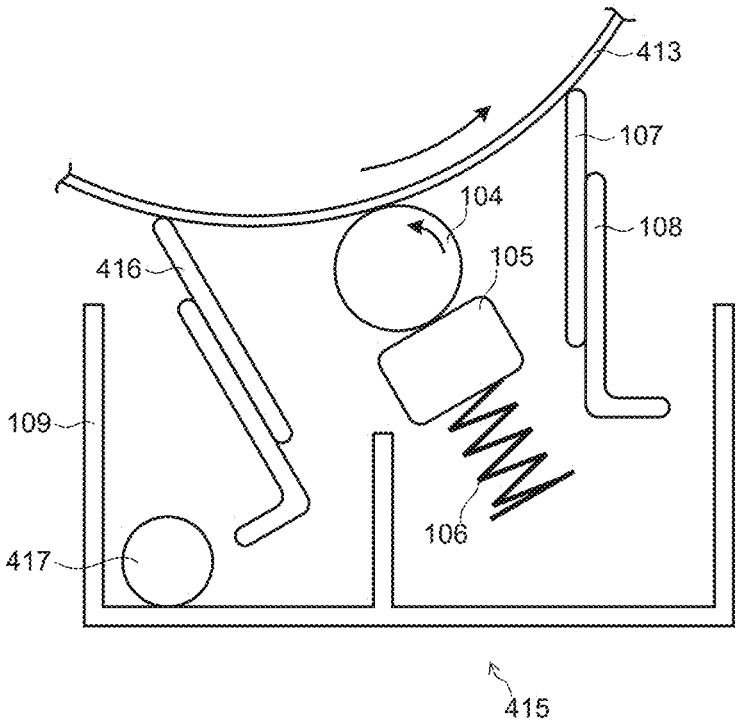
FIG. 3 is a diagram for explaining a configuration for supplying a lubricant to a photoconductor drum in the image forming apparatus of FIG. 1.

Next, with reference to FIG. 3, operation such as supply of a lubricant when a toner image is formed on photoconductor drum 413 will be described. FIG. 3 shows a part of drum cleaning device 415 extracted. As shown in FIG. 3, drum cleaning device 415 includes cleaning blade 416, toner recovery screw 417, lubricant application brush 104, a solid lubricant (lubricant) 105, biasing member 106, leveling blade 107, and supporting metal plate 108, or the like. These parts are attached to storage case 109 which is a frame body of drum cleaning device 415 by an appropriate method.

Cleaning blade 416 is an elastic member formed by molding urethane rubber or the like into a flat plate shape and has a width substantially equal to the width in the axial direction (main scanning direction) of photoconductor drum 413. Cleaning blade 416 has a counter type configuration in which the tip end (edge) of cleaning blade 416 is brought into abutment against photoconductor drum 413 so as to face the rotation direction of photoconductor drum 413. At the time of formation of an image, as photoconductor drum 413 rotates in the arrow direction (counterclockwise direction) in FIG. 3, the transfer residual toner remaining on the surface of photoconductor drum 413 is scraped off by cleaning blade 416.

Toner recovery screw 417 collects the transfer residual toner scraped off by cleaning blade 416 and conveys the transfer residual toner to a waste toner recovery container (not shown).

Lubricant application brush 104 plays a roll of supplying the lubricant of solid lubricant 105 onto the photoconductor drum (image bearing member) 413. Lubricant application brush 104 is a roller-like brush in which a base cloth on which fibers such as polyester is implanted is wound around a core metal, and has a width substantially equal to the width of photoconductor drum 413 in the axial direction. Lubricant application brush 104 is arranged so as to be in contact with the surface of solid lubricant 105 and the surface of photoconductor drum 413, and as shown by an arrow in FIG. 3, rotates in the opposite direction from the rotation of photoconductor drum 413 (counterclockwise direction) to supply the lubricant onto photoconductor drum 413. Lubricant application brush 104 is in contact with photoconductor drum 413 in the scanning direction (axial direction) with a uniform pressure.

solid lubricant 105 is formed by solidifying the lubricant into a rod shape, and is hereinafter referred to as a lubricant rod. Lubricant rod 105 is fixed to a holder (not shown) connected to biasing member 106. The width of lubricant rod 105 is narrower than the width of cleaning blade 416 and leveling blade 107. Lubricant rod 105 has a hardness equivalent to F to HB in pencil hardness, for example. The lubricant used for lubricant rod 105 is, for example, zinc stearate (ZnSt).

Biasing member 106 includes, for example, a compression spring, and presses lubricant rod 105 toward lubricant application brush 104 with a predetermined pressing load (for example, 1.2 to 2.6N). As a result, lubricant rod 105 is held in contact with lubricant application brush 104.

As similar to cleaning blade 416, leveling blade 107 is an elastic member formed of a urethane rubber or the like into a flat plate shape, and has a width substantially equal to the width of photoconductor drum 413 in the axial direction (main scanning direction). Leveling blade 107 is supported by supporting metal plate 108. Leveling blade 107 is arranged so as to be in sliding contact with the photoconductor drum 413 by a predetermined contact angle (for example, 50°) and a penetration amount from the accompanying direction (the direction in which the edge portion is dragged when photoconductor drum 413 rotates).

At the time of formation of an image, lubricant application brush 104 rotates to scrape off the lubricant from the surface of lubricant rod 105, and the scraped lubricant (hereinafter, referred to as lubricant) is applied to the surface of photoconductor drum 413 in the contact portion with photoconductor drum 413. The lubricant on applied photoconductor drum 413 comes into contact with the edge portion of leveling blade 107 to become a lubricant accumulation, and the lubricant accumulation is leveled by leveling blade 107 to form a lubricant film having a substantially uniform thickness on photoconductor drum 413.

Fluctuations in the coverage of the toner image printed on sheet S may cause uneven supply of the lubricant on photoconductor drum 413, which may cause image defects.

If the coverage is zero, the lubricant supplied from lubricant application brush 104 onto photoconductor drum 413 during performing of the print job is uniformly applied onto photoconductor drum 413 on which no toner image is formed. Here, when the state of low coverage continues for a long time, the lubricant applied on photoconductor drum 413 is accumulated on photoconductor drum 413 as a lubricant accumulation in between photoconductor drum 413 and leveling blade 107, which causes density uneveness, FD streaks, or the like of the later printed image. Such a problem can be dealt with by discharging the toner band (refresh toner patch) by the RFP control described above.

On the other hand, in the case of high coverage such as solid image printing, a larger amount of lubricant is consumed as compared with the case of zero coverage. That is, the lubricant supplied from lubricant application brush 104 onto photoconductor drum 413 has a property of easily adhering to the formed toner image.

When eccentric location of high coverage portions occurs, such as a case of printing a large number of images with high coverage only in a specific portion of sheet S in the width direction, such as a prize sheet including a frame line, the lubricant will locally decrease in the high coverage portion. In this case, the shape of lubricant rod 105 in the width direction is distorted (locally decreases), and the lubricant supply to photoconductor drum 413 is imbalanced during the subsequent printing, which may cause image defects. In addition, when the external additive is contained in the toner to be used, when the eccentric location of the high coverage as described above occurs, the external additive adheres to the locally decreased portion of lubricant rod 105, and lubricant rod 105 is easily stained.

When an image (toner image) having high coverage only in a specific portion in the width direction as described above is printed on a long sheet, local decrease of lubricant rod 105 is easy to occur.

Figure 4:
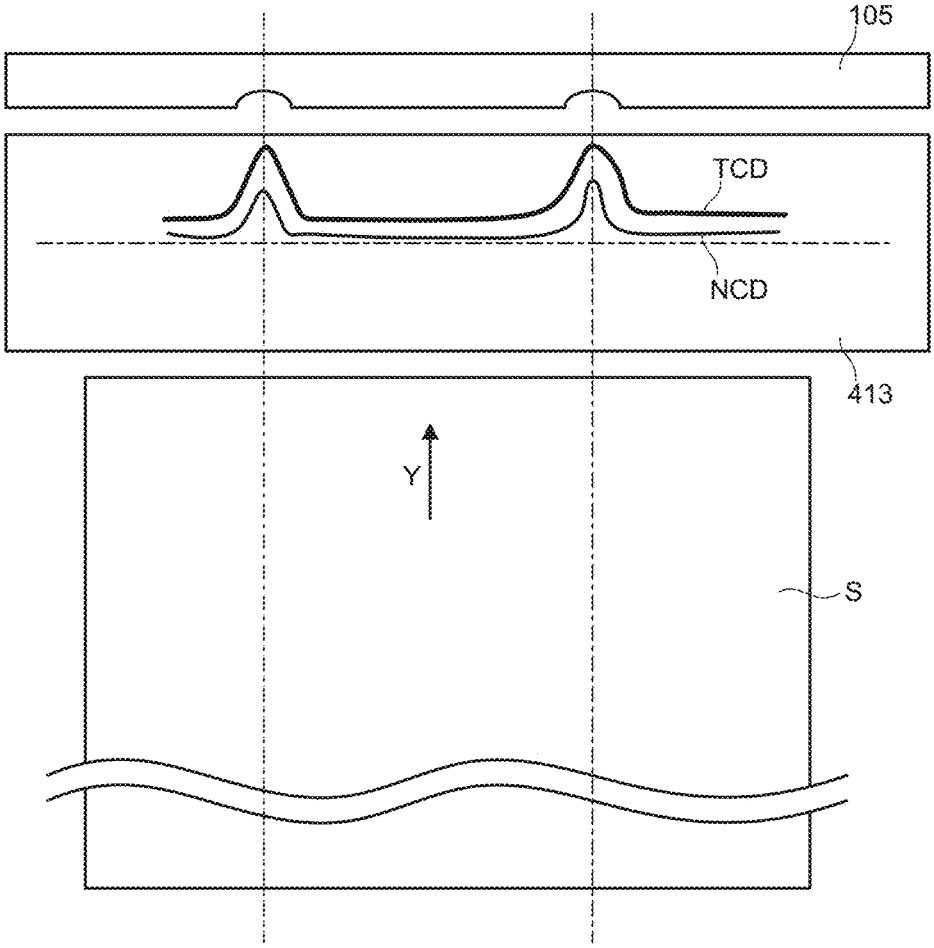
FIG. 4 is a diagram for explaining problems in the case where eccentric distribution of coverage occurs in a conventional image forming apparatus.

With reference to FIG. 3 and FIG. 4, the problem in the case where there is eccentric distribution of the coverage of the toner image formed on photoconductor drum 413 will be described in more detail.

FIG. 4 is a diagram showing an assumed case in which a toner image mainly having two thick lines (see one-dot chain line in FIG. 4) which are substantially parallel to the conveyance direction is printed on sheet S, and the printing of the toner image is consecutively performed on a large number of sheets S. In FIG. 4, the characteristic of the coverage distribution in the axial direction of the toner image formed on photoconductor drum 413 is indicated by the characteristic line of TCD and NCD. Here, NCD is a characteristic line showing the coverage distribution when the toner image is printed on one sheet S, and TCD is a characteristic line showing the total coverage distribution when the toner image described above is repeatedly printed on a large number of sheets S.

As described above, when the high coverage portions of the toner image formed on photoconductor drum 413 is focused (eccentrically located) at a specific position in the axial direction, stress concentrates on the corresponding portion of cleaning blade 416, which causes deterioration, rolling up, or the like. In this case, the transfer residual toner on photoconductor drum 413 passes through cleaning blade 416 without being cleaned. At this time, the passed toner adheres to lubricant application brush 104 and subsequently adheres to lubricant rod 105. Here, since the friction of the portion of lubricant application brush 104 to which the toner is adhered is larger than that of the other portions, more lubricant is scraped off than the other portions of lubricant rod 105, and the scraped lubricant is supplied to photoconductor drum 413.

As a result, as shown in FIG. 4, the region of lubricant rod 105 corresponding to the high coverage portion (two thick lines in this example) of the toner image is consumed more, and a dent (local decrease) occurs in part (two places in this example) of lubricant rod 105 in the width direction. As described above, when distortion of the shape of lubricant rod 105 in the width direction is larger, application unevenness of the lubricant on photoconductor drum 413 is easy to occur, and the distortion eventually causes deterioration in image quality such as occurrence of FD streaks. When the toner contains an external additive, by the operation as described above, the region of lubricant rod 105 corresponding to the high coverage portion of the toner image is soiled with the external additive, and the purity of the lubricant applied on photoconductor drum 413 is lowered, so that the external additive also causes the occurrence of FD streaks or the like.

In order to solve such a problem, it is conceivable to perform the RFP control described above during sheet feed (between sheets). Here, when the RFP control is performed, the following effects are expected with respect to lubricant supply of lubricant rod 105. That is, a refresh toner patch (toner band) is supplied onto photoconductor drum 413 between sheets S by the RFP control, so that a lubricant excessively accumulated on photoconductor drum 413 is adhered to the toner band, and it is expected that image defects due to excessive lubricant is suppressed. On the other hand, the RFP control has the following problems in addition to the above-described increase in toner consumption amount and the like.

Normally, in the RFP control, in order to prevent the toner band discharged onto intermediate transfer belt 421 from being transferred to secondary transfer roller 424, control is performed for releasing the pressure bonding between components of the secondary transfer nip, that is, intermediate transfer belt 421 and secondary transfer roller 424. On the other hand, when the RFP control is performed between sheets while preventing decrease in productivity of printing as much as possible, it is necessary to shorten the time for releasing the pressure bonding between intermediate transfer belt 421 and secondary transfer roller 424 as much as possible. In this case, the toner band discharged onto intermediate transfer belt 421 may be transferred to secondary transfer roller 424, and adhere to the lower surface of next sheet S from secondary transfer roller 424. In order to avoid such a problem, it is necessary to provide a cleaning mechanism such as a scraper (blade) for removing the toner band on secondary transfer roller 424.

When such a problem is dealt with without providing such a cleaning mechanism, in order to prevent the toner band from transferring to secondary transfer roller 424, as described above, it is necessary to temporarily release the pressure bonding between intermediate transfer belt 421 and secondary transfer roller 424. In this case, in the printing operation, it is necessary to increase the distance between sheets S to be conveyed consecutively or temporarily stop sheet S, so that productivity of printing is lowered.

In general, it is desirable that the lubricant of lubricant rod 105 is consumed as evenly as possible in the width direction, that is, in the axial direction of photoconductor drum 413, and is applied uniformly in the axial direction on photoconductor drum 413. However, depending on the image or the like to be printed, various problems due to eccentric distribution of the coverage may occur. Then, when such a problem is dealt with the RFP control, there is a limit in terms of cost and productivity of printing.

Further, although the RFP control can deal with the case where the lubricant is excessively supplied onto photoconductor drum 413, the RFP control cannot deal with the opposite case, that is, the case where the lubricant on photoconductor drum 413 tends to be insufficient due to high coverage printing or the like. In addition, the RFP control cannot suppress contamination such as adhesion of external additives accompanying local deformation (decrease) of lubricant rod 105.

In order to deal with the above problem, a method is also conceivable, the method of displacing the position in the axial direction of the toner image formed on photoconductor drum 413 by a fixed value, changing the target position on the side end of sheet S according to the displaced amount, and performing the displacement control of registration roller pair 53*a* until sheet S enters the secondary transfer nip. However, although this method can achieve a high effect when sheet S is a regular sheet, the following limitation arises when sheet S is a long sheet.

That is, a long sheet is long in the conveyance direction, and similar symbols are consecutively printed often on a long sheet. For this reason, the influence such as the local decrease of lubricant rod 105 per sheet when eccentric distribution of the high coverage occurs, is larger than that of normal sheet S such as a regular sheet. Therefore, in a case of a long sheet, the control of simply displacing the image formation position and the target position as described above may not sufficiently suppress unevenness in lubricant supply to photoconductor drum 413.

In addition, in some cases, the long sheet is fed from a dedicated sheet feed device attached to image forming apparatus 1, and in this case, at the stage when the tip end of the long sheet in the conveyance direction reaches the secondary transfer nip, the rear end side of the long sheet may still be pressure bonded to the sheet feed roller of the sheet feed device. In such a case, not only before the tip end of the long sheet enters the secondary transfer nip but also after entering the secondary transfer nip (that is, during the secondary transfer of the toner image), the side end of the long sheet is easy to be displaced.

Therefore, in image forming apparatus 1 of the present embodiment, control section 100 performs control of dynamically changing the position in the axial direction of the toner image formed on photoconductor drum 413 (image bearing member) on the basis of the distribution status of the toner in the axial direction on the toner image formed on photoconductor drum 413. In control of the registration displacement, control section 100 controls displacement of registration roller pair 53*a* after the tip end of sheet S in the conveyance direction enters the secondary transfer nip, so that the position in the width direction of the sheet of the image transferred onto sheet S at the secondary transfer nip position is correct.

Here, "dynamically changing" means not displacing the position in the axial direction of the toner image formed on photoconductor drum 413 by a fixed value (fixedly) but, for example, displacing the position to move in the oblique direction with respect to the axial direction (scanning direction) or in the vibration direction along the axial direction, as described above. More specific contents of the control for dynamically changing the position of the toner image in the axial direction will be described later.

In a specific example, control section 100 analyzes input image data before the operation of performing print, specifies the eccentric distribution of the toner in the axial direction on the toner image formed on photoconductor drum 413, to dynamically change the position of the toner image in the axial direction formed on photoconductor drum 413 on the basis of the specification result. Note that as a result of analyzing the input image data, when the eccentric distribution of the input toner cannot be specified (that is, when it is determined that there is no eccentric distribution), control section 100 determines that lubricant rod 105 is not possibly decreased locally by such printing operation, and does not change the position of the toner image in the axial direction formed on photoconductor drum 413.

In a specific example, control section 100 refers to the distribution history of the toner in the axial direction on the toner image that has been actually formed on photoconductor drum 413 to dynamically change the position in the axial direction of the toner image formed on photoconductor drum 413. Therefore, control section 100 stores the toner distribution or frequency in the axial direction in the toner image formed on photoconductor drum 413 in storage section 72 as total coverage history data (hereinafter, referred to as print history data) of the toner image, and updates the print history data every time the print job is performed. Such print history data is preferably data from the time of the initial use or replacement of lubricant rod 105. Then, prior to the print performing operation, control section 100 analyzes the input image data as described above, and refers to the print history data stored in storage section 72 to determine whether the position in the axial direction of the toner image formed on photoconductor drum 413 is changed, and determine the change mode (dynamic change pattern and change amount of the image) when the position is changed.

In a specific example, control section 100 controls image forming section 40 so as to form a linear pattern of linearly (that is, in the oblique direction) displacing along the axial direction (scanning direction) as a dynamic change pattern (hereinafter simply referred to as change pattern) of the position in the axial direction of the toner image formed on photoconductor drum 413 (see the image I shown by a dotted line in FIG. 6). In another example, control section 100 controls image forming section 40 so as to form a vibration pattern (for example, reciprocating in a wave shape) of vibration along the axial direction (scanning direction) as a change pattern of the position in the axial direction of the toner image formed on photoconductor drum 413. Here, in a case of forming the toner image with the above-described vibration pattern, the way to vibrate is arbitrary, such as vibrating with a gentle amplitude, or conversely, vibrating like a high frequency. The above-described change pattern is an example, and various other change patterns can be used.

Thus, when image formation control is performed so as to form the above-described change pattern as a toner image, a so-called distorted toner image different from usual is formed on photoconductor drum 413, and such a distorted toner image is transferred to intermediate transfer belt 421. Therefore, after sheet S enters the secondary transfer nip, control section 100 performs control of displacing registration roller pair 53*a* with a displacement pattern corresponding to the change pattern of the toner image transferred to intermediate transfer belt 421, thereby causing secondarily transfer of the toner image having the shape defined in the input image data onto sheet S.

By performing the above-described control, as compared to a case where the position in the axial direction of the toner image formed on photoconductor drum 413 is displaced by a certain value (that is, fixedly) to either the left or the right, the eccentric location of the high coverage with respect to one sheet S can be more gentle. Therefore, according to the present embodiment, even when an image having eccentric distribution of high coverage regions is printed on a long sheet, unevenness in lubricant supply to photoconductor drum 413 can be sufficiently suppressed, and occurrence of image defects caused by unevenness in lubricant supply can be prevented or suppressed.

The control contents in the present embodiment will be described in more detail with reference to FIG. 5 and FIG. 6.

Figure 5:
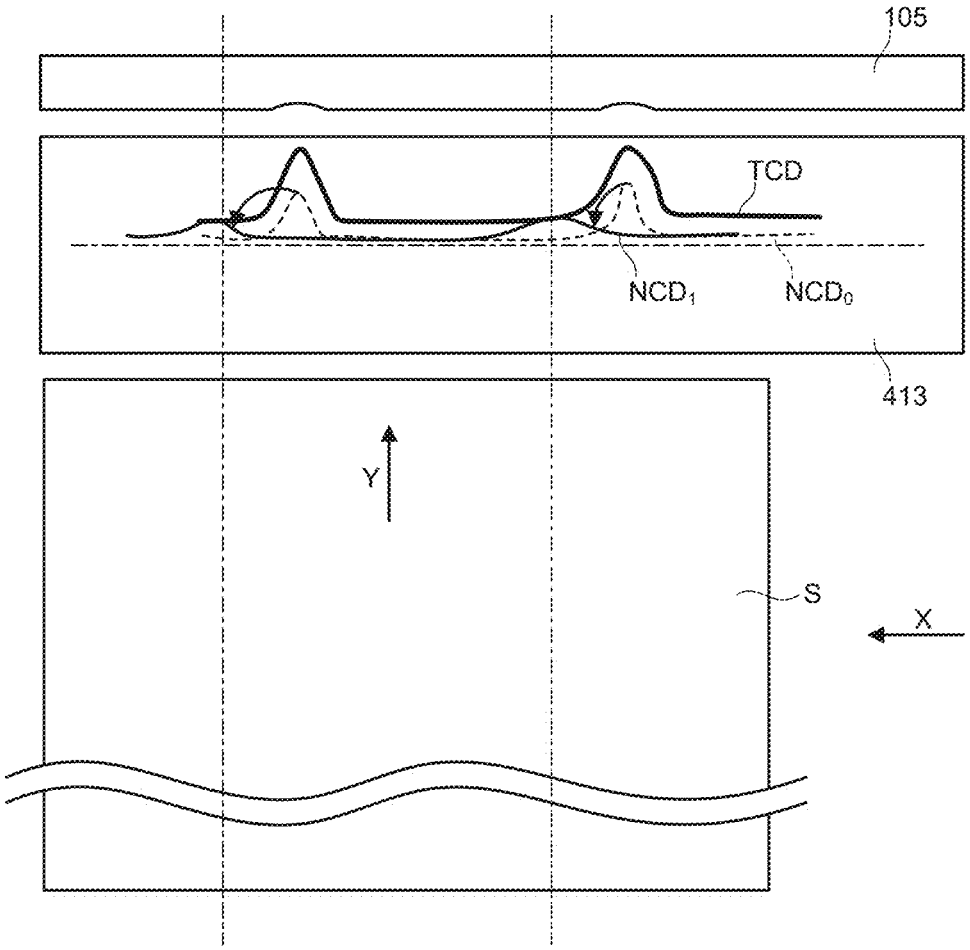
FIG. 5 is a diagram for explaining the outline of image formation control in the image forming apparatus of the present embodiment.

FIG. 5 is a diagram corresponding to FIG. 4 described above, and is an assumed case in which a toner image mainly having two thick lines which are substantially parallel to the conveyance direction is printed on sheet S, and the printing of the image is consecutively performed on a large number (for example, 100 sheets) of sheets S. In FIG. 5, the characteristic of the coverage distribution in the axial direction of the toner image formed on photoconductor drum 413 is indicated by the characteristic lines of TCD, $NCD_0$, and $NCD_1$. Here, the characteristic line of TCD is similar to that in FIG. 4, and the characteristic line of $NCD_0$ is similar to that of NCD in FIG. 4.

In the above-described case where the toner image is consecutively printed on a large number of sheets S, when normal image formation control is performed, as described above with reference to FIG. 4, the local decrease of lubricant rod 105 and image defects caused by the decrease may occur.

On the other hand, in a specific example of the present embodiment, prior to performing of a print job, control section 100 calculates characteristics ($NCD_0$, TCD) of the coverage distribution in the axial direction of the toner image formed on photoconductor drum 413 on the basis of input image data for the job and setting information such as the number of sheets to be printed. Control section 100 determines whether the position on the X axis (scanning) direction (hereinafter referred to as the image formation position) of the toner image formed on photoconductor drum 413 is dynamically changed on the basis of the calculation result.

For example, when the characteristic line (TCD) of the calculated total coverage distribution has a peak shape (see FIG. 5) and the peak value exceeds the threshold, control section 100 determines that high coverage portions are eccentrically located and lubricant rod 105 may be partially decreased, and determines that the image formation position is dynamically changed.

FIG. 5 shows a case where control section 100 determines that the image formation position is changed, and the formation position of the toner image with respect to sheet S from the fifty-first sheet to the hundredth sheet, for example, is moved (gradually displaced) toward the left side in the axial direction of photoconductor drum 413 linearly in an oblique direction. In this case, as shown in FIG. 6, for sheets S from fifty-first sheet, after the tip end of sheet S in the conveyance direction enters the secondary transfer nip, control section 100 gradually displaces the reference position (the target position) of the side end of sheet S from the normal position ($TP_0$) to the left position ($TP_1$). Control section 100 performs displacement control of registration roller pair 53*a* so that the side end of sheet S matches with the target position that is dynamically displaced in this way. As shown in FIG. 6, such swing control causes toner lines formed obliquely on photoconductor drum 413, and in turn, on intermediate transfer belt 421 (see toner image I shown by a dotted line in FIG. 6) are secondarily transferred on sheet S in a straight line.

Note that control section 100 controls the displacement of registration roller pair 53*a* so that the target position of the side end of sheet S is aligned with the normal or initial position (the position $TP_0$ in FIG. 6), for the sheet in which the image formation position is not changed (in the example described above, sheets S from the first sheet to the fiftieth sheet). In a specific example, when sheet S is a regular sheet or the like other than a long sheet, after the tip end of sheet S enters the secondary transfer nip, control section 100 does not perform displacement control of registration roller pair 53*a*. On the other hand, in an environment where the position of the side end is easy to be displaced, such as when sheet S is a long sheet, in order to secure the position of the toner image to be transferred onto sheet S, control section 100 continues displacement control of registration roller pair 53*a* even after the tip end in the conveyance direction enters the secondary transfer nip. In any case, in normal printing operation in which the image formation position is not changed, a toner image having a shape defined in the input image data is formed and transferred onto photoconductor drum 413 and intermediate transfer belt 421, so that the target position of the side end of sheet S can be fixed to the normal or the initial position (the position $TP_0$ in FIG. 6).

On the other hand, when the image formation position (change pattern of the toner image) of the toner image formed on photoconductor drum 413 is dynamically changed to the distorted pattern as described above, before the tip end of sheet S in the conveyance direction enters the secondary transfer nip, control section 100 performs registration displacement control in a similar manner to usual. When the tip end of sheet S in the conveyance direction enters the secondary transfer nip, control section 100 changes the target position of the side end of sheet S to be dynamically displaced from initial position $TP_0$ so that an image of a correct shape is transferred on sheet S, according to the pattern of the formed toner image. In the example shown in FIG. 6, as a change pattern of the toner image, a pattern of displacing linearly (in the left oblique direction) along the axial direction of photoconductor drum 413 is formed on photoconductor drum 413. Therefore, control section 100 dynamically displaces the target position of the side end after entering the secondary transfer nip of sheets S from the fifty-first sheet from initial position $TP_0$ to the position of the $TP_1$ on the left side, and displaces in real time registration roller pair 53*a* so that the side end position of sheet S is aligned with the displaced target position.

Such control of dynamic changing the image formation position (pattern change of the toner image) as described above, the characteristic line of the coverage distribution on photoconductor drum 413 when printing is performed on one sheet S changes from $NCD_0$ to $NCD_1$. As can be seen by comparing these characteristic lines, characteristic line $NCD_1$ of the coverage distribution on photoconductor drum 413 when the pattern of the toner image is changed is lower in a peak value than characteristic line $NCD_0$, and is a gentle line. Therefore, in a case of performing the control of pattern change of the toner image, it is possible to suppress the peak value of the total coverage distribution (TCD) to further lower than in a case of simply displacing the position in the axial direction of the toner image formed on photoconductor drum 413 by a certain value (that is, shifting the position of the peak value).

According to the present embodiment in which the control as described above is performed, local decrease of lubricant rod 105 can be suppressed, and problems such as image defects caused by the local decrease can be prevented or suppressed. By dynamically changing the target position of the side end of sheet S after entering the secondary transfer nip, in accordance with the change of the image formation position (pattern change of the toner image) to control the registration displacement, the toner image that is secondarily transferred on sheet S can be printed in an original correct shape.

The above-described control content is an example, and in the present embodiment, various control contents can be applied as follows.

In a specific example of the present embodiment, control section 100 refers to the print history data from the initial use of lubricant rod 105 to change the pattern of the toner image so that the image formation position on photoconductor drum 413 is displaced linearly along the axial direction (that is, in an oblique direction on the right or left). In this case, control section 100 saves the print history data from the initial use of lubricant rod 105 in a memory such as storage section 72, and updates the print history data for every predetermined number of printed sheets S (for example, every one sheet).

At the time of performing the print job, control section 100 specifies the content of the print job (the coverage distribution of the input image data, the set number of pages, the number of print copies, or the like). Control section 100 specifies the original coverage distribution in the axial direction of the toner image to be formed on photoconductor drum 413 ($NCD_0$ shown in FIG. 5), and reads the print history data indicating the total coverage distribution (TCD) from the initial use of lubricant rod 105 described above.

Here, control section 100 specifies unevenness of the formation position in the axial direction of the toner image formed on photoconductor drum 413, on the basis of the acquired two coverage distributions (TCD and $NCD_0$), and dynamically changes the image formation position of the toner image according to the specification result. For example, as shown in FIG. 5, when coverage distribution $NCD_0$ is approximate to total coverage distribution TCD, control section 100 determines that lubricant rod 105 may be locally decreased, and performs control of changing the pattern of the toner image so as to dynamically displace the image formation position of the toner image formed on photoconductor drum 413.

The above-described control according to the present embodiment can be suitably used in a case where the same toner image (image) is repeatedly printed for a large number of sheets (copies) or a number of sheets (copies) exceeding a threshold. For example, when the user setting information indicates that a hundred sheets of the same image are printed or ten or more copies of a plurality of pages are printed, control section 100 automatically performs the above-described operation. In this case, control section 100 acquires the user setting information and the input image data before the start of the print operation, calculates the total coverage distribution from the start to the end of the print job, and determines the change pattern of the toner image for dynamically changing the image formation position, the number of sheets S to be changed, or the like. Further, control section 100 can refer to the above-described print history data to perform more suitable control for preventing occurrence of image defects.

Alternatively, the threshold (a hundred sheets or ten copies in this example) may be arbitrarily set or changed by the user through a user setting screen (not shown). In this case, control section 100 determines the change mode of the toner image formed on photoconductor drum 413, and the change mode of the target position of the side end of sheet S after entering the secondary transfer nip, for each preset threshold number N ($N \geq 1$) of sheets S.

For example, from the viewpoint of making the way of decrease of lubricant rod 105 uniform as much as possible, control of changing the pattern of the toner image and changing the target position of the side end of sheet S after entering the secondary transfer nip in the present embodiment is preferably performed for every one sheet S (the threshold is preferably set to 1). On the other hand, when such control is performed for every one sheet S, the position of the side end of sheet S ejected to sheet ejection section 52 differs from one sheet to another, so that convenience such as sorting of each outputted sheet S may be deteriorated, for example, the sheet ejection state is uneven in the same job. In a case where a post-processing device having a finisher (alignment plate) is connected to image forming apparatus 1, it is possible to eliminate unevenness in the sheet ejection state as described above. In general, the above-mentioned threshold can be arbitrarily set in consideration of the above-mentioned use environment and the like.

In a specific example, prior to the image formation process, control section 100 analyzes the toner image formed on photoconductor drum 413, and according to the analysis result, control section 100 determines or changes the image formation position of the toner image on photoconductor drum 413 (pattern of the toner image). Here, in a case where the same image is consecutively printed on sheets S of a threshold number or more of sheets (for example, a hundred sheets), control section 100 controls image forming section 40 so as to dynamically change the image formation position on photoconductor drum 413 (change the pattern of the toner image) for every predetermined number of sheets (for example, ten sheets).

At this time, control section 100 appropriately refers to the above-described print history data to dynamically change the image formation position on photoconductor drum 413 so that the unevenness of the formation position in the axial direction of the toner image formed on photoconductor drum 413 is dispersed. For example, control section 100 controls image forming section 40 to displace the formation position of the toner image on photoconductor drum 413 to the left oblique direction of the axial direction with respect to first sheet S as shown in FIG. 5, and displace the position in the right oblique direction of the axial direction with respect to second sheet S. Such control causes the history of the coverage distribution of the toner image formed on photoconductor drum 413 to approach to flat, and the way of decrease of lubricant rod 105 is made uniform.

In a case where the axial position of the toner image formed on photoconductor drum 413 is dynamically changed as described above, control section 100 normally dynamically changes the reference position of the side end of sheet S in the same mode (the displacement direction and speed) as the displacement mode by the changed pattern of the toner image, to perform control of registration displacement. By such control, an image is formed in the original correct position on sheet S.

On the other hand, in such a uniform control, the image formation position on sheet S may not be correct. For example, when a toner image is printed on both sides of sheet S, the state of sheet S is greatly different between the registration displacement of the first surface and the registration displacement of the second surface. Specifically, at the time of the registration displacement of the second surface, since the toner image fixed on the first surface (lower surface) of sheet S is printed, registration roller pair 53*a* and sheet S slide, and a desired displacement amount may not be obtained in some cases.

Therefore, according to the image forming conditions (the first surface or the second surface of sheet S in this example), control section 100 sets the amount of change in the axial position of the toner image formed on photoconductor drum 413, and the amount of change in the reference position of the side end of sheet S after entering the secondary transfer nip to different values to perform the above-described control. Specifically, when printing on the second surface of sheet S is performed in the double-sided print job, control section 100 considers an insufficient amount of displacement at the time of the registration displacement, sets the change amount of the reference position of the side end of sheet S (hereinafter, also referred to as a displacement offset amount) to be larger than the displacement amount of the toner image (hereinafter, also referred to as an image offset amount), and performs the above-described control.

The number of printed sheets of sheet S serving as a reference for switching the image offset amount and the displacement offset amount can be arbitrarily changed or set through the user setting screen or the like. The user may arbitrarily set the change pattern of the toner image formed on photoconductor drum 413 (such as an oblique linear pattern, a wavy vibration pattern, or the like), the image offset amount, and the displacement offset amount through a user setting screen or the like. In a case where the toner image formed on photoconductor drum 413 is an oblique linear pattern, the image offset amount that can be set here includes, for example, a value of the inclination direction or the inclination angle of the linear pattern, and when the toner image is a wavy vibration pattern, the amplitude value of the vibration pattern. In this case, control section 100 determines the pattern of the toner image, the image offset amount, and the displacement offset amount on the basis of these pattern of the toner image and set value of the offset amount set by the user. Hereinafter, the change pattern of the toner image formed on photoconductor drum 413 and the image offset amount are collectively referred to as an image change mode.

In such a configuration, for example, in order to reduce inconveniences due to uneven sheet ejection, use methods are considered such as setting only one of the offset directions of the image and displacement (for example, left direction), or setting the offset amount to small. On the other hand, in a case where a post-processing device having a finisher (alignment plate) is connected to image forming apparatus 1, in order to make the way of decrease of lubricant rod 105 uniform as much as possible, a use method such as maximizing the offset amount is also considered. That is, when the above-described post-processing device is connected, the inconvenience caused by uneven sheet ejection can be eliminated.

The image change mode and the displacement offset amount may be arbitrarily set by the user in accordance with the formation mode of the toner image printed on sheet S (that is, the shape, type of the figure, or the like of the output image defined in the input image data). For example, control section 100 displays buttons such as "with border" or "with partial solid image" on a user setting screen, and when such a button is selected, control section 100 displays defined values of the image change mode and the displacement offset amount, and displays these defined values so that the user can change them.

In any of the cases described above, it is necessary for the displacement offset amount to be set to be equal to or less than the maximum displacement amount of registration roller pair 53*a*. Here, the maximum displacement amount is the maximum value (limit distance) at which registration roller pair 53*a* can move from the initial position to the left and right in the width direction (front and depth direction of the apparatus). That is, registration roller pair 53*a* is in a home position (initial position) before the print job is performed, and there is a mechanical limit value of movement from the initial position in the left and right direction (front and depth direction of the apparatus) in the width direction. Therefore, when determining the displacement offset amount, control section 100 sets the displacement offset amount within a range not exceeding the maximum displacement amount of registration roller pair 53*a*. When determining the image offset amount, control section 100 sets the image offset amount within a range not exceeding the limit distance (displacement offset amount) in the displacement operation of corresponding registration roller pair 53*a*.

As described above, in a case of a configuration in which the user can set (change) the image offset amount and the displacement offset amount, control section 100 provides limitation in a setting of the maximum value of the offset amount, or performs display of warning to the user, so that the user does not perform setting exceeding the maximum displacement amount of registration roller pair 53*a*.

Control section 100 can perform the RFP control in combination with control of the dynamic change of the above-described image formation position and the target position of the sheet side end according to the image formation condition. In this case, control section 100 controls image forming section 40 to form a toner band (a refresh toner patch) having a width corresponding to the width of photoconductor drum 413 in a region on photoconductor drum 413 corresponding to between a plurality of sheets S conveyed consecutively. By performing such RFP control in combination, the peak value of the characteristic line (TCD) of the above-mentioned total coverage distribution can be lowered, the unevenness in lubricant supply on photoconductor drum 413 is further suppressed, and the risk of quality deterioration of the image to be printed is reduced.

Here, examples of the image formation condition using the RFP control in combination include user setting information for setting on (permitted)/off (forbidden) of the RFP control. For example, in a case of printing a large number of sheets of images with eccentric location of high coverage as described above, when the user desires to lower the risk of image quality deterioration or the like, the user performs setting of turning on (permits) the RFP control through the user setting screen or the like.

On the other hand, when more emphasis is placed on productivity (printing speed), the user performs setting of turning off (forbids) the RFP control through the user setting screen or the like. In this case, during the performing of the print job, control section 100 performs the above-described control of the dynamic change of the image formation position and the target position, and does not perform the RFP control.

Examples of the image formation condition using the RFP control in combination include a case where control section 100 determines that the local decrease of lubricant rod 105 still occurs (is not suppressed) even after the above-described image formation position is dynamically changed. Such a case may occur, for example, when the image offset amount set by the user is small (for example, when the inclination angle of the linear pattern is small, the amplitude amount of the vibration pattern is small, or the like). As described above, since there is a physical limit value in the image offset amount and the displacement offset amount, depending on the printing conditions (the formation mode of a toner image, the number of sheets to be printed, or the like), the above-described eccentric location of high coverage may not be eliminated sufficiently. In such a case, using the above-described RFP control in combination can suppress the occurrence of local decrease of lubricant rod 105.

Figure 7:
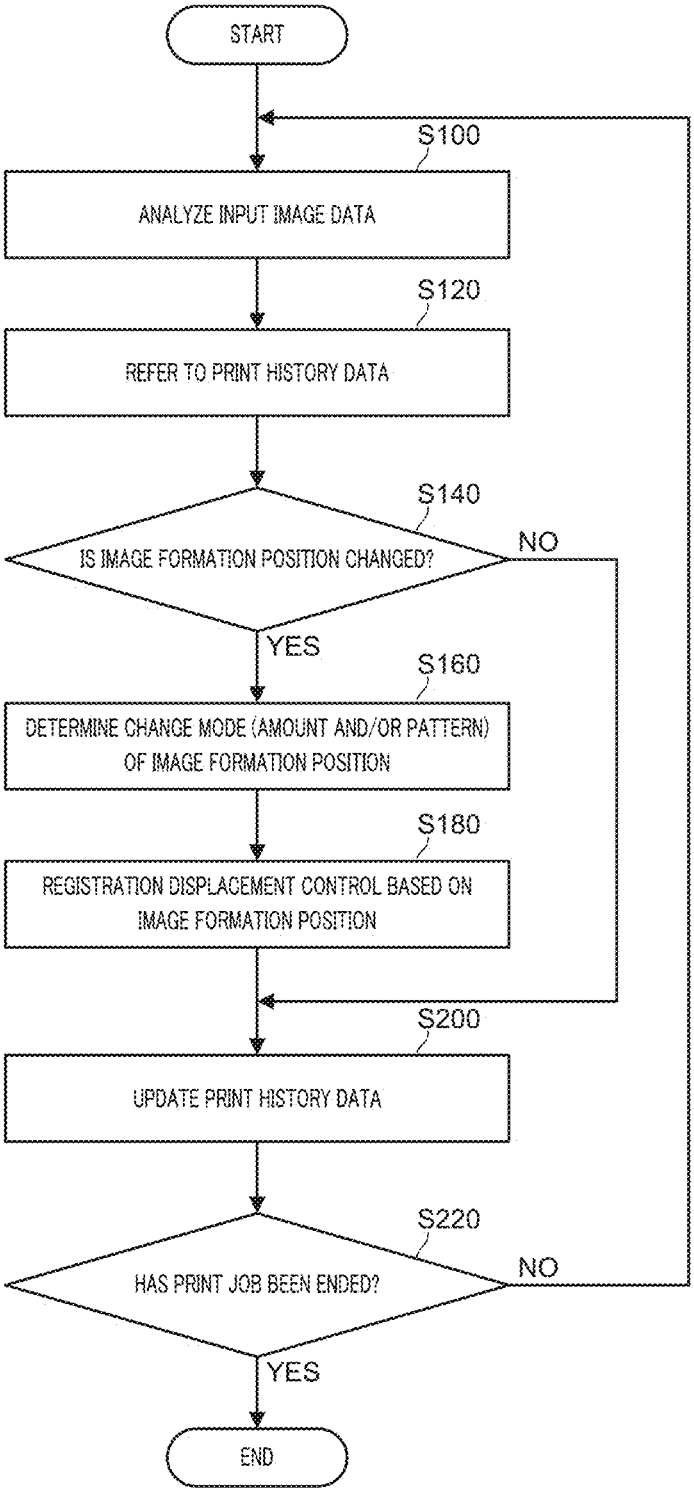
FIG. 7 is a control flowchart showing an example of the operation at the time of performing a print job in the image forming apparatus of the present embodiment.

Hereinafter, an example of processing performed by control section 100 upon performing of a print job in image forming apparatus 1 will be described with reference to a flowchart of FIG. 7. In the example shown in FIG. 7, for simplicity, it is assumed that a long sheet is used as sheet S and a straight line along the length direction of sheet S is printed as an image.

At the time of performing the print job, control section 100 acquires input image data and setting information in the print job, and analyzes the acquired input image data (step S100). Specifically, control section 100 specifies the corresponding position on photoconductor drum 413, that is, the print position in the X axis (scanning) direction and the Y axis (sub scanning) direction in the two-dimensional toner image to be formed on sheet S.

In step S120, control section 100 reads the above-described print history data from storage section 72, and identifies the print frequency at each position in the scanning direction (axial direction) on photoconductor drum 413 as the image bearing member (the number of times of actually adhering a toner).

In step S140, control section 100 determines whether the position on the X axis (scanning) direction (the image formation position) of the toner image formed on photoconductor drum 413 is dynamically changed, on the basis of the processing result in steps S100 and S120.

When it is determined that the image formation position is not dynamically changed (NO in step S140), control section 100 skips the processing in steps S160 and S180, and performs normal image formation control and registration displacement control, and the process proceeds to step S200.

On the other hand, when it is determined that the image formation position is dynamically changed (YES in step S140), control section 100 determines a mode of changing the image formation position (the above-described change pattern of the toner image and the image offset amount) (step S160), and performs image formation control in the determined change mode, and the process proceeds to step S180.

Hereinafter, a case where an oblique linear pattern is used as a change pattern of a toner image will be described. In this example, control section 100 performs control of forming a toner image that is inclined at a predetermined angle from a direction orthogonal to the axial direction of photoconductor drum 413 (Y direction in FIG. 6), on photoconductor drum 413 (see the image I shown by a dotted line in FIG. 6). The toner image (inclined image I) formed on photoconductor drum 413 is primarily transferred onto intermediate transfer belt 421 at the primary transfer nip, and the sheet moves to the secondary transfer nip by the rotation of intermediate transfer belt 421.

Such image formation control in step S160 can prevent the toner from being continuously adhered to a local portion in the X axis (scanning) direction on photoconductor drum 413, and suppress the lubricant and, in turn, lubricant rod 105 from being locally consumed.

In step S180, control section 100 controls the displacement of registration roller pair 53*a* on the basis of the formation position of the toner image on photoconductor drum 413 so that the toner image is secondarily transferred to the correct position in the width direction on sheet S. The control of the registration displacement in step S180 continues until the rear end of sheet S in the conveyance direction passes through registration roller pair 53*a*.

Figure 6:
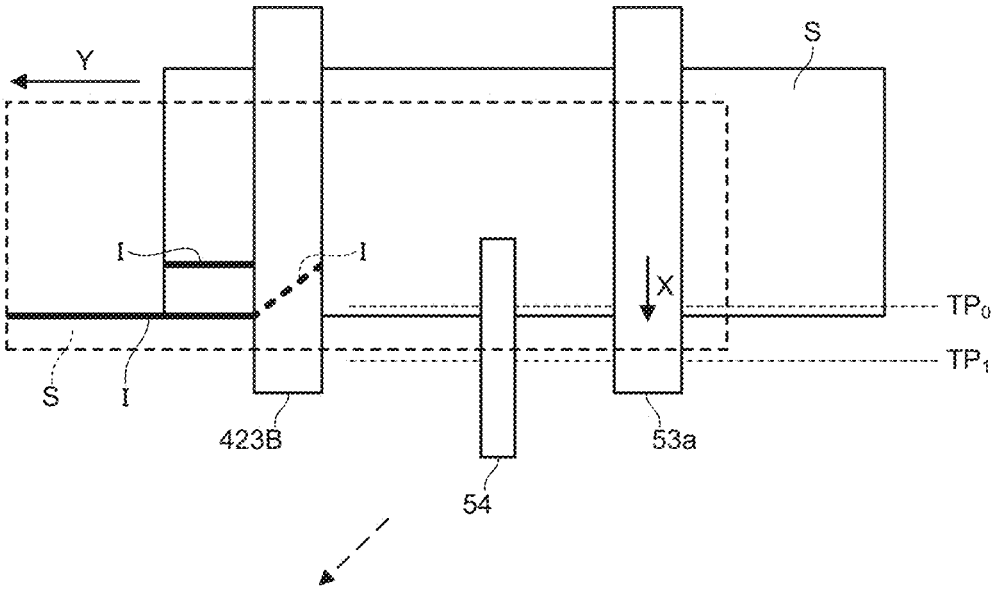
FIG. 6 is a diagram for explaining operation of a registration roller pair, an image formed on a sheet, or the like, in a case where a position of the toner image formed on the photoconductor drum is changed.

When the image formation position is not changed (NO in step S140), control section 100 monitors the detection signal of line sensor 54, and controls the displacement of registration roller pair 53*a* so that the side end of sheet S matches with normal reference position $TP_0$ (see FIG. 6). In this case, control section 100 performs displacement control (that is, control to match the side end of sheet S with reference position $TP_0$) that is similar before and after the tip end of sheet S in the conveyance direction enters the secondary transfer nip. When the rear end of sheet S passes through registration roller pair 53*a*, the process proceeds to step S200. From the viewpoint of the life problem or the like of line sensor 54, it is also possible to adopt a configuration in which the control of the registration displacement is not performed after the tip end of sheet S in the conveyance direction enters the secondary transfer nip, and this will be described in detail later.

On the other hand, when it is determined that the image formation position is dynamically changed (YES in step S140), control section 100 performs control of displacement different in before and after the tip end of sheet S in the conveyance direction enters the secondary transfer nip. That is, in this example, until the tip end of sheet S in the conveyance direction enters the secondary transfer nip, control section 100 controls the displacement of registration roller pair 53*a* so that the side end of sheet S matches with reference position $TP_0$. Subsequently, after the tip end of sheet S in the conveyance direction enters the secondary transfer nip, as shown in FIG. 6, control section 100 controls the displacement of registration roller pair 53*a* so that the toner image on intermediate transfer belt 421 is secondarily transferred to the correct position on sheet S. In this example, control section 100 controls the displacement of registration roller pair 53*a* to cause the side end of sheet S to sequentially move from reference position $TP_0$ to new target position $TP_1$ so that the toner image (image I) obliquely formed on intermediate transfer belt 421 is transferred onto sheet S as a straight line parallel to the length direction of sheet S. For simplicity, only one new target position is shown in FIG. 6. However, control section 100 can set a plurality of new target positions in a way until the rear end of sheet S passes through the registration nip.

With such displacement control, sheet S that has entered the secondary transfer nip is conveyed so that the side end of sheet S is gradually displaced toward the front side of the apparatus (lower side in FIG. 6) from reference position $TP_0$, and is conveyed obliquely (in the lower left direction in FIG. 6) while maintaining the parallel state as indicated by a dotted arrow in FIG. 6. As a result, the toner image obliquely formed on intermediate transfer belt 421 (the image I indicated by the dotted line) is transferred as a straight line parallel to the length direction of sheet S at the secondary transfer nip (see the image I indicated by the solid line in FIG. 6).

Subsequently, control section 100 updates the above-described print history data (step S200), and the process proceeds to step S220. In step S220, control section 100 determines whether the print job has ended. When it is determined that the print job has not ended (NO in step S220), control section 100 returns the process to step S100 and repeats the processes in steps S100 to 220 described above. On the other hand, when control section 100 determines that the print job has ended (YES in step S220), control section 100 ends the series of processes.

According to image forming apparatus 1 of the present embodiment that performs the control as described above, it is possible to suppress unevenness in lubricant supply to photoconductor drum 413, thereby improving the quality of the image printed on sheet S. By suppressing the unevenness in lubricant supply on photoconductor drum 413, it is possible to prolong the life of photoconductor drum 413.

According to the present embodiment, it is possible to avoid the addition of a configuration such as providing a cleaning mechanism on secondary transfer roller 424, thereby reducing the cost. According to the present embodiment, the performing frequency of the RFP control can be reduced even when low-coverage printing is continued, so that toner consumption can be suppressed and cost reduction can be realized also from this point. In addition, according to the present embodiment, the performing frequency of the RFP control is reduced so that the productivity of printing can be improved.

In the embodiment described above, control section 100 analyzes the input image data, and specifies unevenness of the coverage distribution in the axial direction of photoconductor drum 413. As an alternative or additional example, a well-known image reading device (not shown) may be provided, and eccentric distribution of the coverage in the axial direction of photoconductor drum 413 may be specified by control section 100 on the basis of the result of actually reading the toner image formed on photoconductor drum 413 by the image reading device.

In the configuration described above, whether control of the registration displacement is performed only before sheet S enters the secondary transfer nip, or performed even after sheet S enters the secondary transfer nip may be switched automatically according to image forming conditions or the like, or by user setting. Here, in addition to the presence or absence of the eccentric location of the high coverage (the possibility of local decrease of lubricant rod 105) described above, the type of sheet, the degree of deterioration (usage history) of line sensor 54, or the like are exemplified as the image forming conditions or the like.

Specifically, when the registration displacement control is performed both before and after sheet S enters the secondary transfer nip, another problem occurs, that is, durability (life) deteriorates due to an increase in the use time of line sensor 54. From the viewpoint, when sheet S is a regular sheet, control section 100 performs only the control of registration displacement before the tip end of sheet S in the conveyance direction enters the secondary transfer nip, regardless of presence or absence of the above-described eccentric location of the high coverage (the possibility of partial decrease of lubricant rod 105). When it is determined that there is eccentric location of the high coverage described above (the possibility of partial decrease of lubricant rod 105), control section 100 performs control of displacing the axial position of the toner image formed on photoconductor drum 413 by a fixed value (the position of the peak value of characteristic line $NCD_0$ in FIG. 5 is simply shifted to the left, for example). In accordance with the simple shift of the image formation position, control section 100 controls the displacement of registration roller pair 53*a* so that the side end of sheet S matches with the position displaced from normal reference position $TP_0$ (see $TP_1$ in FIG. 6) in the control of the registration displacement before sheet S enters the secondary transfer nip.

Such control of a simple shift of the image formation position causes the position of the peak value of characteristic line $NCD_0$ of the coverage distribution when printing is performed on one sheet S (regular sheet in this example) to be shifted in the width direction (left side in this example), so that the peak value of the total coverage distribution (TCD) can be suppressed to low. As a result, local decrease of lubricant rod 105 can be suppressed, and problems such as image defects caused by the local decrease can be prevented or suppressed. By changing the target position of the side end of sheet S in accordance with the change of the image formation position (simple shift) to control the registration displacement before entering the secondary transfer nip, the transfer position of the toner image on sheet S at the time of entering the secondary transfer nip can be aligned to the original correct position in the width direction. Since the control of registration displacement is not performed after entering the secondary transfer nip, the use time of line sensor 54 is reduced, and the life of line sensor 54 can be extended.

As described above, in a case where sheet S is not a long sheet such as a regular sheet, the processing of switching so as not to perform the control of the registration displacement after entering the secondary transfer nip may be performed automatically by control section 100 when the life of line sensor 54 is in the last stage. In this case, control section 100 refers to the use history information of line sensor 54 to switch so as not to perform the control of the registration displacement after entering the secondary transfer nip when the life indicates the last stage of the life. At the same time, control section 100 displays on display section 21 or the like that the replacement timing of line sensor 54 is close.

On the other hand, in a case where a sheet feed device (not shown) is connected to image forming apparatus 1, and a long sheet is fed as sheet S from the sheet feed device, the long sheet enters the secondary transfer nip while being fed from the sheet feed device as described above in some cases. In this case, there is a problem that the side end of the long sheet is easy to be displaced even during the secondary transfer of the toner image due to the absence of a separating mechanism in the sheet feed roller of the sheet feed device. Therefore, in such a case, control section 100 performs the control of the registration displacement both before and after sheet S enters the secondary transfer nip. However, when the life of line sensor 54 is in the last stage, the above-described processing (the processing of switching so as not to perform the control of the registration displacement after entering the secondary transfer nip) may be performed. In this case, control section 100 displays, on display section 21 or the like, that the replacement timing of line sensor 54 is close, and that there is a possibility that the quality of the output image will be lowered.

In general, control section 100 can selectively perform the control (first control) of dynamically changing the image formation position and the target position of the sheet side end in the registration displacement after entering the secondary transfer nip, and the control (second control) of displacing the image formation position by a certain value to displace registration roller pair 53*a* according to the displacement amount of the position in the axial direction of the toner image until the tip end of sheet S reaches the secondary transfer nip, on the basis of the distribution status of the toner in the axial direction in the toner image formed on photoconductor drum 413, depending on the type of sheet S and use history of line sensor 54.

In the above-described embodiment, a case has been described in which the sheet conveyance member provided on the upstream side of the secondary transfer nip and displacement-controlled by control section 100 is registration roller pair 53*a*. As another example, the sheet conveyance member may additionally or alternatively be, for example, a roller other than registration roller pair 53*a*, a sheet conveyance guide, or the like.

In the above-described embodiment, a case in which a sheet paper is used as the sheet has been described. On the other hand, the above embodiment can also be similarly applied to a roll paper.

Although embodiments of the present invention have been described and illustrated in detail, the disclosed embodiments are made for purpose of illustration and example only and not limitation. The scope of the present invention should be interpreted by terms of the appended claims.

What is claimed is:

1. An image forming apparatus, comprising:

an image former including a transferer that transfers a toner image formed on an image bearing member to a sheet;

a lubricant supplier that supplies the image bearing member with a lubricant of a lubricant rod extending along an axial direction of the image bearing member;

a sheet conveyance member that is provided in an upstream side of the transferer in a sheet conveyance direction, and conveys the sheet; and a hardware processor that controls displacement of the sheet conveyance member so as to displace the sheet along a width direction of the sheet, wherein the hardware processor performs control of changing a position in the axial direction of the toner image formed on the image bearing member, on the basis of a distribution status of a toner in the axial direction in the toner image formed on the image bearing member, and controls displacement of the sheet conveyance member after a tip end of the sheet in the conveyance direction enters the transferer so that a sheet position in a width direction of an image transferred onto the sheet is correct in the transferer.

2. The image forming apparatus according to claim 1, wherein the hardware processor refers to distribution history of the toner in the axial direction in the toner image actually formed on the image bearing member to dynamically change the position in the axial direction of the toner image formed on the image bearing member.

3. The image forming apparatus according to claim 1, wherein the hardware processor specifies eccentric distribution of the toner in the axial direction in the toner image formed on the image bearing member to dynamically change the position in the axial direction of the toner image formed on the image bearing member, according to a specification result.

4. The image forming apparatus according to claim 1, wherein the hardware processor analyzes input image data, and dynamically changes the position in the axial direction of the toner image formed on the image bearing member, on the basis of an analysis result.

5. The image forming apparatus according to claim 1, wherein the hardware processor dynamically changes the position in the axial direction of the toner image formed on the image bearing member so that a peak value of a characteristic line of total coverage distribution of the toner in the axial direction in the toner image formed on the image bearing member is low.

6. The image forming apparatus according to claim 1, wherein the hardware processor dynamically changes the position in the axial direction of the toner image formed on the image bearing member so that eccentric distribution of the toner in the axial direction in the toner image formed on the image bearing member is dispersed.

7. The image forming apparatus according to claim 1, wherein the hardware processor controls the displacement of the sheet conveyance member so as to align a side end of the sheet with a target position, and dynamically changes the target position when the position in the axial direction of the toner image formed on the image bearing member is dynamically changed.

8. The image forming apparatus according to claim 7, wherein the hardware processor changes the target position by an amount different from a change amount of the position in the axial direction of the toner image formed on the image bearing member.

9. The image forming apparatus according to claim 7, wherein the hardware processor determines a change amount of the position in the axial direction of the toner image formed on the image bearing member and a change amount of the target position on the basis of a set value set by a user.

10. The image forming apparatus according to claim 9, wherein the change amount of the position in the axial direction of the toner image formed on the image bearing member and the change amount of the target position is settable according to a formation mode of the toner image.

11. The image forming apparatus according to claim 7, wherein the hardware processor determines a change amount of the target position so that the change amount does not exceed a maximum displacement amount of the sheet conveyance member.

12. The image forming apparatus according to claim 11, wherein the hardware processor changes the position in the axial direction of the toner image formed on the image bearing member so that the change amount does not exceed the maximum displacement amount of the sheet conveyance member.

13. The image forming apparatus according to claim 1, wherein the hardware processor controls the image former to displace the position in the axial direction of the toner image formed on the image bearing member linearly along a scanning direction.

14. The image forming apparatus according to claim 1, wherein the hardware processor controls the image former to vibrate the position in the axial direction of the toner image formed on the image bearing member along a scanning direction.

15. The image forming apparatus according to claim 1, wherein the hardware processor performs in combination with control of forming a toner patch with which a peak value of a characteristic line of total coverage distribution of the toner in the axial direction in the toner image formed on the image bearing member is low, in a region of the image bearing member corresponding to between sheets of a plurality of the sheet conveyed consecutively.

16. The image forming apparatus according to claim 15, wherein the hardware processor performs control of forming the toner patch in combination, according to user setting information.

17. The image forming apparatus according to claim 15, wherein the hardware processor performs control of forming the toner patch in combination when it is determined that a local decrease of the lubricant rod is not suppressed even after the position in the axial direction of the toner image formed on the image bearing member is changed.

18. The image forming apparatus according to claim 1, wherein the sheet is a long sheet.

19. The image forming apparatus according to claim 1, wherein the hardware processor selectively performs, on the basis of the distribution status of the toner in the axial direction in the toner image formed on the image bearing member, first control of changing the position in the axial direction of the toner image formed on the image bearing member, and displacing the sheet conveyance member in a displacement mode according to a change mode of the position in the axial direction of the toner image after a tip end of the conveyance direction of the sheet enters the transferer, and second control of displacing the position in the axial direction of the toner image formed on the image bearing member by a certain value, and displacing the sheet conveyance member according to a displacement amount of the position in the axial direction of the toner image until the tip end of the conveyance direction of the sheet reaches the transferer.

20. The image forming apparatus according to claim 19, wherein the hardware processor performs the second control according to a type of the sheet.

21. The image forming apparatus according to claim 19, wherein the hardware processor performs the second control according to use history of a sensor for detecting a side end of the sheet.

22. An image forming control method in an image forming apparatus, the image forming apparatus comprising:

an image former comprising a transferer that transfers a toner image formed on an image bearing member to a sheet;

a lubricant supplier that supplies a lubricant of a lubricant rod extending along an axial direction of the image bearing member onto the image bearing member; and a sheet conveyance member that is provided on an upstream side of the transferer in a sheet conveyance direction, and conveys the sheet, the method comprising:

changing a position in the axial direction of the toner image formed on the image bearing member, on the basis of a distribution status of a toner in the axial direction in the toner image formed on the image bearing member and displacing the sheet conveyance member after a tip end of the sheet in the conveyance direction enters the transferer so that a sheet position in a width direction of the toner image transferred onto the sheet is correct.

* * * * *